United States Patent [19]

Kitajima et al.

[11] 4,329,044

[45] May 11, 1982

[54] CLEANING APPARATUS

[75] Inventors: Tadayuki Kitajima; Toshirou Kasamura; Tomohiro Aoki; Yoshihiko Takeoka, all of Yokohama; Kiyokazu Namekata, Machida, all of Japan

[73] Assignee: Canon Kabushiki Kaisha, Tokyo, Japan

[21] Appl. No.: 223,688

[22] Filed: Jan. 9, 1981

Related U.S. Application Data

[63] Continuation of Ser. No. 971,436, Dec. 20, 1978, abandoned.

[30] Foreign Application Priority Data

Dec. 28, 1977 [JP] Japan ..... 52-160132

[51] Int. Cl.[3] ..... G03G 21/00

[52] U.S. Cl. ..... 355/15; 15/256.51; 118/652; 355/3 DR

[58] Field of Search ..... 355/3 R, 3 DR, 15; 15/256.51, 256.52; 101/425; 118/652

[56] References Cited

U.S. PATENT DOCUMENTS

| | | | |
|---|---|---|---|
| 3,190,198 | 6/1975 | Eichorn | 355/3 R X |
| 3,879,124 | 4/1975 | Eppe et al. | 355/15 |
| 3,917,398 | 11/1975 | Takahashi et al. | 355/15 |
| 3,927,936 | 12/1975 | Komori et al. | 355/15 |
| 4,032,229 | 6/1977 | Tani et al. | 355/15 |

*Primary Examiner*—Fred L. Braun

*Attorney, Agent, or Firm*—Fitzpatrick, Cella, Harper & Scinto

[57] ABSTRACT

Apparatus for cleaning an image carrier in an image forming device has a cleaning member, support structure for supporting the cleaning member in such manner as to make the cleaning member contact the image carrier and pressing members engageable with the outer and inner surfaces of the image carrier to grasp it.

12 Claims, 6 Drawing Figures

CLEANING APPARATUS

This is a continuation of application Ser. No. 971,436, filed Dec. 20, 1978, now abandoned.

BACKGROUND OF THE INVENTION

1. Field of the Invention

The present invention relates to a cleaning apparatus for cleaning the surface of an image carrier in an image forming apparatus of the type in which a developed image is formed on the image carrier and the formed image is used for various purposes. More particularly, the present invention relates to improvements in the above mentioned cleaning apparatus in order to minimize the possibility of the inner and outer parts of the image forming apparatus being contaminated at the time of maintenance service of the image carrier such as during removal and remounting thereof.

2. Description of the Prior Art

For a long time there has been known and widely used such type of image forming apparatus in which a developed image is formed on an image carrier, the formed developed image is used in various ways, for example, by transferring it onto a transferring member and, after the use of the image, the surface of the image carrier is cleaned up for its repetitive use.

One example of such image forming apparatus is that for the electrophotographic process in which a photosensitive medium having a photoconductive layer is used as the image carrier. The photosensitive medium is exposed image-wise to light to form an electrostatic latent image thereon and the latent image is developed on the photosensitive medium to obtain a visualized image which is then transferred for use. A concrete example of this type of apparatus is disclosed in U.S. Pat. No. 2,297,619 (Carlson), U.S. Pat. No. Re. 29,632 (Tanaka et al) or others.

Another example is that for so-called screen process in which an electrostatic latent image is formed on a photosensitive medium having a plurality of openings and an electrostatic image is formed on an insulating image carrier by modulating and controlling an ion stream in accordance with the previously formed electrostatic latent image. The electrostatic image is then developed on the image carrier to obtain a visualized image for further use. This type of image forming apparatus is disclosed, for example, in U.S. Pat. No. 3,976,484 (Ando).

Furthermore, it is known to apply to electrode pins or the like a voltage corresponding to an image signal so as to form an electrostatic image on an insulating image carrier as mentioned above and then to develop the electrostatic image.

In these image forming apparatus, the image carrier such as a photosensitive medium should be cleaned for repetitive use thereof. For this purpose, various cleaning methods have been known and used. Examples thereof include the fur brush cleaning method as disclosed in U.S. Pat. No. 3,534,427 (Severynse) and U.S. Pat. No. Re. 29,632 (Tanaka et al), the web cleaning method as disclosed in U.S. Pat. No. 3,740,864 (Ito et al) and the blade cleaning method as disclosed in U.S. Pat. No. 3,927,936 (Komori) and Re (Ito et al) U.S. Pat. No. Re. 29,632 (Tanaka et al). In particular, the last mentioned cleaning method is of high efficiency and the device required for carrying out the method is simple in structure.

For the sake of repetitive use, the image carrier used in an image forming apparatus as mentioned above is often formed as an endless member and is supported on a drum. This is known as a photosensitive drum. Since such image carrier in a form of drum must be serviced for maintenance and exchanged for a new one after a long use, it is usually constructed removably from the image forming apparatus and the mounting and removal of the image carrier is usually done independently of the associated cleaning device.

On the other hand, it is a common practice in the art that the cleaning means itself is also constructed removably from the image forming apparatus independently of other parts of the apparatus.

However, when such a photosensitive drum is removed from the image forming apparatus, there often occurs the trouble of the falling of developing powder which remains in the cleaning device or the scattering of developing powder resulting from contact of the cleaning device with the photosensitive drum. Also, developing powder which remains on the drum surface may scatter at that time. This falling and scattering of developing powder not only makes the interior of the copying machine dirty but also damages the apparatus. Developing powder scattered into gaps in the bearings or the like will disturb the smooth rotation of the shafts and reduce the durability of the apparatus. All of such troubles will finally result in a reduced reliability of the image forming apparatus.

To avoid this trouble, hitherto, it was required to remove the developing powder which remains in the cleaning device whenever the photosensitive drum was removed from the image forming apparatus. This was very troublesome and time-consuming. For the same reason, the position at which the cleaning device may be mounted was limited. This means that the cleaning device sometimes can not be mounted at the position which is considered optimum for mounting in view of the design of the copying machine.

All of the above problems are solved by the present invention.

SUMMARY OF THE INVENTION

Accordingly, it is an object of the invention to provide a cleaning apparatus which avoids the problem of contamination of image forming apparatus when maintenance service and inspection are carried out on the apparatus.

It is another object of the invention to provide a cleaning apparatus which does not make dirty the outer and inner parts of the image forming machine at the time of removal and mounting of the image carrier of the apparatus.

It is a further object of the invention to provide a cleaning apparatus which can come into good engagement with the image carrier.

To attain the above objects according to the invention, the cleaning apparatus is made in such manner that it can be mounted onto or removed from the image forming apparatus together with the image carrier while keeping a good engagement between the cleaning apparatus and the image carrier.

Thus, the cleaning apparatus of the present invention comprises a cleaning member, a supporting means for supporting said cleaning member in such manner as to make the cleaning member contact an image carrier and means engageable with said image carrier to grasp it.

Other and further objects, features and advantages of the invention will appear more fully from the following description taken in connection with the accompanying drawings.

DESCRIPTION OF THE PREFERRED EMBODIMENTS

Figure 1:
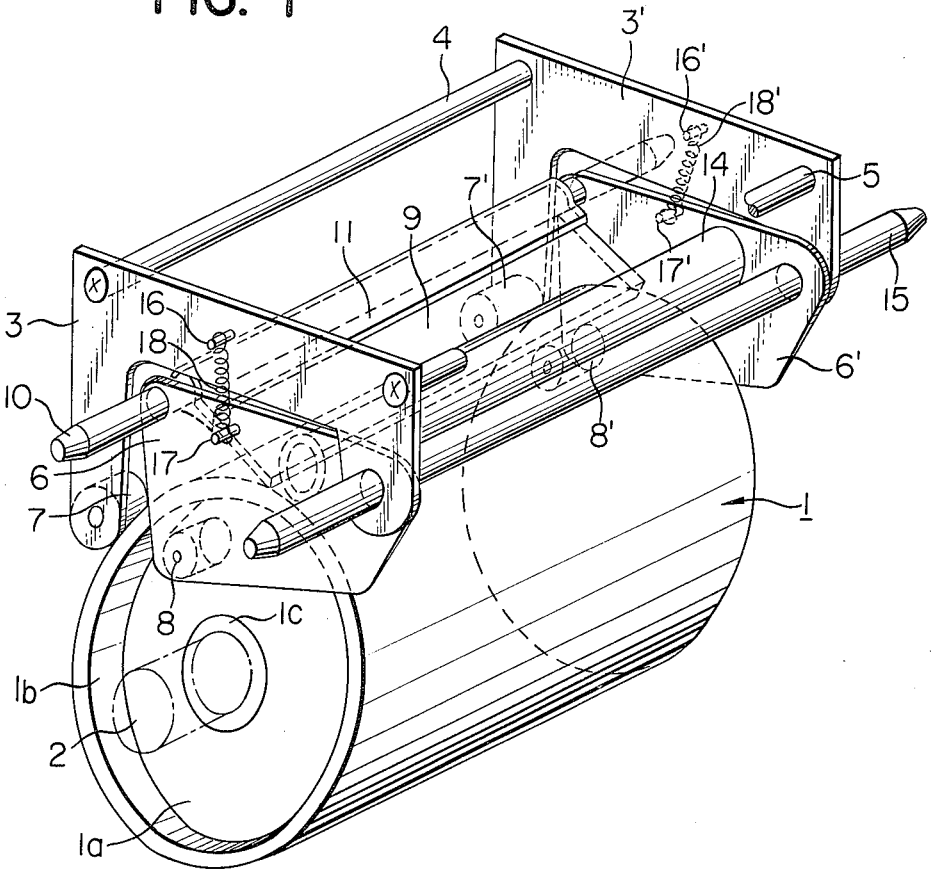
FIG. 1 is a perspective view of an image carrier of an image forming apparatus to which a cleaning apparatus according to the invention is applied.
Figure 2:
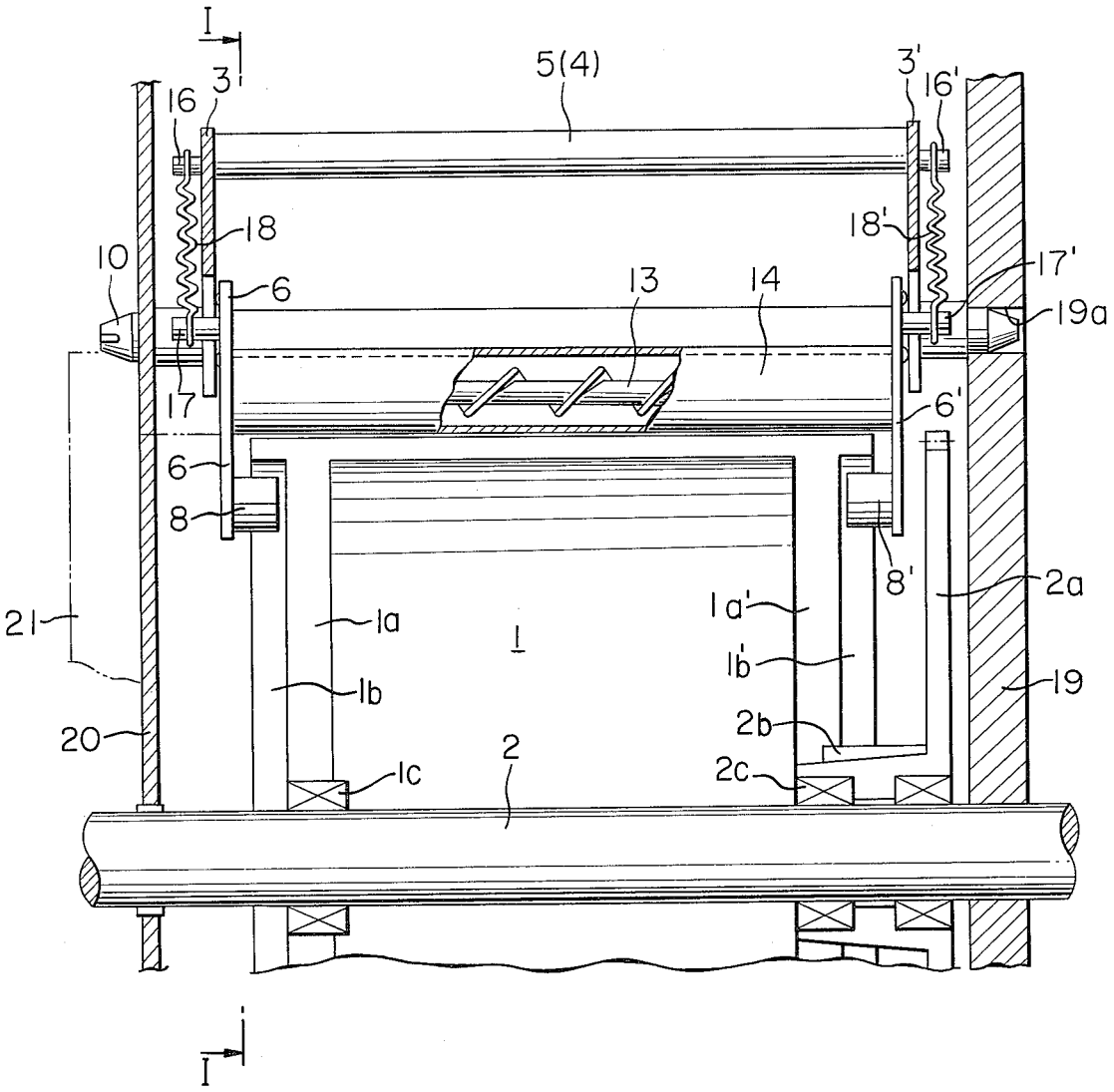
FIG. 2 is a sectional view thereof.

Referring first to FIGS. 1 and 2 showing a preferred embodiment of the present invention, the reference numeral 1 designates an image carrier formed as a photosensitive drum adapted for an image forming apparatus. 1*a* is a drum supporting plate which is fitted into the drum 1. The supporting plate 1*a* is spaced from the end of the drum inwards so that the inner surface of the drum is exposed partly at the end part of the drum (see 1*b*). The supporting plate 1*a* has a center bore provided with a bearing 1*c* for a supporting shaft 2 indicated by a chain-dotted line. The supporting shaft 2 is secured, at both ends, to the main body of the apparatus (not shown) and is received by the bearing 1*c* in such manner as to allow the rotation of the supporting plate 1*a* and therefore the rotation of the drum 1 about the shaft 2.

At both ends of the drum 1, there are disposed main side plates 3 and 3' and sub-side plates 6 and 6' opposed to each other with the drum being somewhat sandwiched therebetween. These two pairs of side plates constitute an essential part of the cleaning apparatus of the invention. The sub-side plates 6 and 6' are connected with each other by a stay 10 to which also a blade holder 11(12) is fixed for holding a cleaning member, that is, an elastic blade 9. This stay 10 serves also as a guide for mounting the cleaning apparatus on the image forming apparatus. The elastic blade 9 scrapes off the residual developer from the surface of the drum. The residual developer scraped from the surface of the drum is transported to the area outside of the drum surface by a screw 13 supported by the pair of sub-side plates 6 and 6'. A sleeve 14 covers the screw and defines a transportation channel for the residual developer. After being conveyed through the channel, the residual developer is discarded or reused. The sub-side plates 6 and 6' have, at their lower end portions, rollers 8 and 8' respectively. These rollers are in contact with the inner side surface of the drum, that is, the backside surface of the image carrier.

The main side plates 3 and 3' are connected with each other by stays 4 and 5. The main side plates have rollers 7 and 7' respectively, which are in contact with both side ends of the drum surface. The main side plates 3, 3' and the sub-side plates 6, 6' are pivotable about a guide shaft 15 independently of each other. The main side plate 3 and the sub-side plate 6 have pins 16 and 17 respectively and also the main side plate 3' and the sub-side plate 6' have pins 16' and 17' respectively. Between the pins 16 and 17 there extends a tension spring 18 which intends to urge the plates 3 and 6 toward each other. At the same time, between the pins 16' and 17' there extends a tension spring 18' which intends to urge the plates 3' and 6' toward each other.

FIG. 2 shows, in cross-section, the cleaning apparatus in the position which it takes when mounted on the image forming apparatus.

At the mounting, both ends of the stay 10 and the guide shaft 15 are engaged in slots 19*a* at one end and in slots 20*a* at the other end provided on the wall of supporting plate 19 of the main frame of the image forming apparatus and on the wall of a keep plate 20 respectively. Stay 10 and guide shaft 15 thus disable the action of rollers 8,8'. Thus, the cleaning apparatus is fixed to the image forming apparatus and the stay 10 as well as the guide shaft 15 are correctly positioned relative to the supporting shaft 2 of the drum 1. Accordingly, the cleaning blade 9 held by the blade holder 11,12 provided on the stay 10 can come into pressure contact with the surface of the drum 1 at a predetermined position and under a predetermined condition to scrape the developer remaining on the circumferential surface of the drum. The developer scraped by the blade is then conveyed through the sleeve 14 by the screw 13 up to a duct 21 provided on the keep plate 20. The duct 21 returns the developer back to a developing apparatus (not shown) for reuse. In a manner known per se, the angle of the cleaning blade 9 to the surface of the drum 1 is adjustable by rotating a member (not shown) secured to the stay 10 to set an optimum contact pressure for the cleaning blade.

On the other hand, the drum 1 which was inserted into the image forming apparatus for mounting together with the above described cleaning apparatus, is rotatably supported by the supporting shaft 2 fixed to the main frame of the image forming apparatus. The supporting shaft 2 has a gear 2*a* fixedly mounted thereon to transmit the driving force from a driving source (not shown) to the drum 1. To this end, the gear 2*a* has en engaging projection 2*b* engageable with the central bore of the supporting plate 1*b'* for the drum 1 and a bearing 2*c* for the supporting shaft 2.

Figure 3:
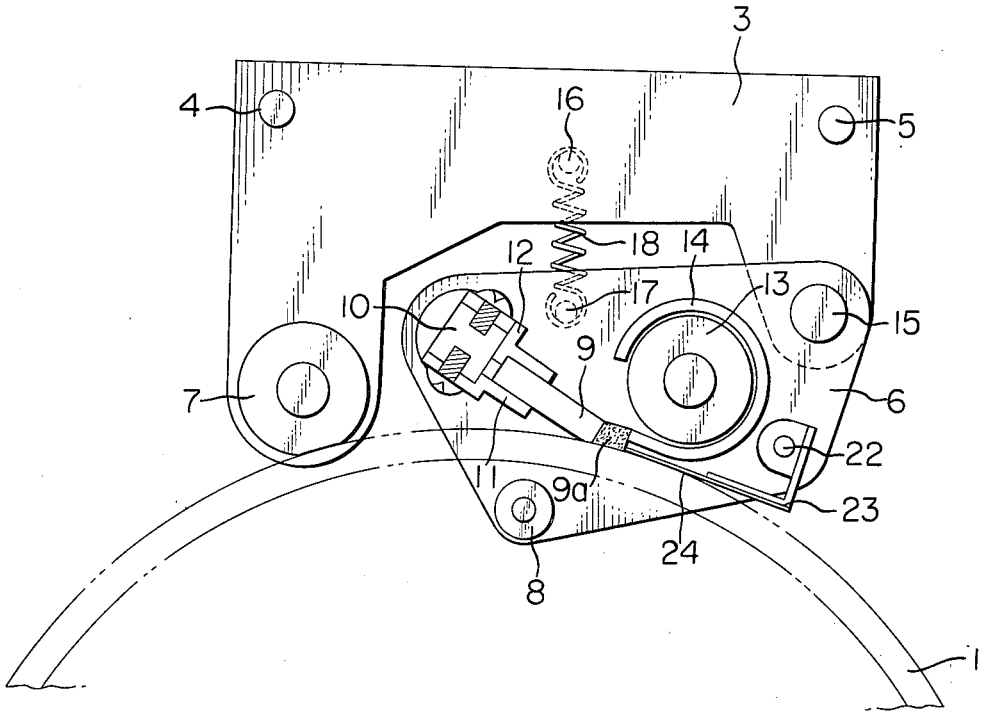
FIG. 3 is a cross-section taken along the line I—I in FIG. 2 wherein the cleaning apparatus is in its operative position.

After the completion of mounting of the cleaning apparatus on the image forming apparatus, as seen best in FIG. 3, the tension springs 18 and 18' continue to hold their tightly stretched state. Therefore, the rollers 8 and 8' on the sub-side plates are kept apart from the backside surface of the drum 1 in a disabled state. In this position, the rollers never hinder the rotation of the drum 1.

In order to prevent the developer from falling down from the side ends of the drum surface, the cleaning blade 9 has a sealing member 9*a* provided at both ends. Also, a sheet member 24 is provided under the sleeve 14 to prevent the developer from falling down from there. The sheet member 24 is made of flexible material and secured to a supporting member 23 which is in turn mounted on a shaft 22 rotatable about the shaft. The shaft 22 is fixed to the sub-side plate 6.

Figure 4:
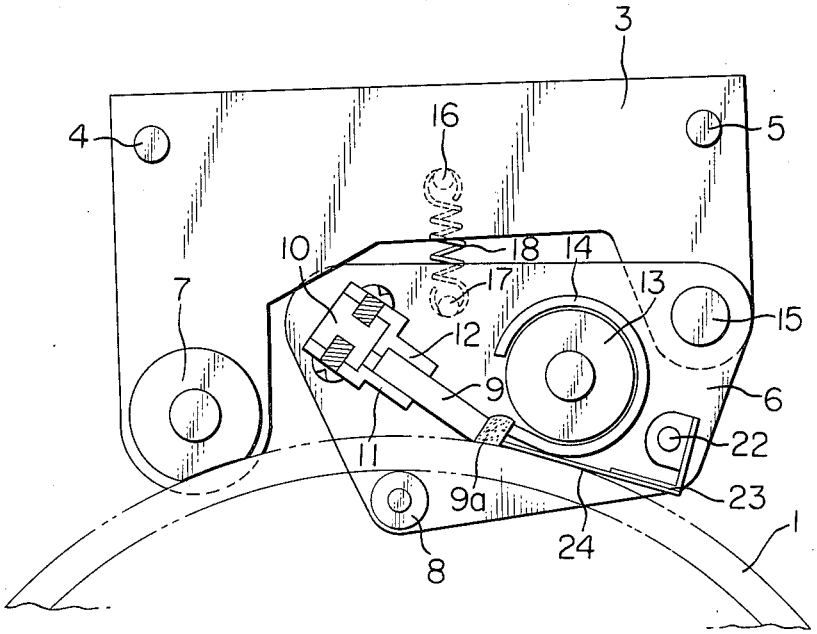
FIG. 4 is a cross-section similar to FIG. 3 but showing the cleaning apparatus in the position which it takes at the time of its mounting or removal.

When the cleaning apparatus and the drum have to be removed from the image forming apparatus, the ends of the stay 10 and the guide shaft 15 are disengaged from the above mentioned slots formed on the walls of the plates 19 and 20 respectively. This disengagement results in releasing the springs 18 and 18' as seen best in FIG. 4. Therefore, the main side plates 3, 3' and the sub-side plates 6, 6' are urged toward each other under the spring force so that the roller 8 of the sub-side plate is engaged with the inner side surface of the drum 1 at its side end part and the sleeve 14 and the roller 7 of the main side plate are pressed against the outer side surface of the drum. In this manner, the roller 7 and the sleeve 14 on the outer surface of the drum and the roller 8 on the under side grasp the drum therebetween so as to fix the cleaning apparatus to the drum. Thus, the cleaning apparatus and the drum 1 are removed together as a single unit from the image forming apparatus. Since the cleaning apparatus and the drum are removed together from the image forming apparatus in this manner, all the problems associated with falling and scattering of developing powder which may occur when the drum and the cleaning apparatus are removed separately, can be eliminated. This prevents the image forming apparatus from being contaminated by the residual developing powder and serves to extend the life of the other parts of the apparatus and to maintain the reliability of the image forming apparatus.

While, in the above embodiment, the blade type of cleaning apparatus has been shown particularly, any other suitable cleaning apparatus may be used for the same purpose. Furthermore, two or more cleaning units may be provided to a single photosensitive drum.

Figure 5:
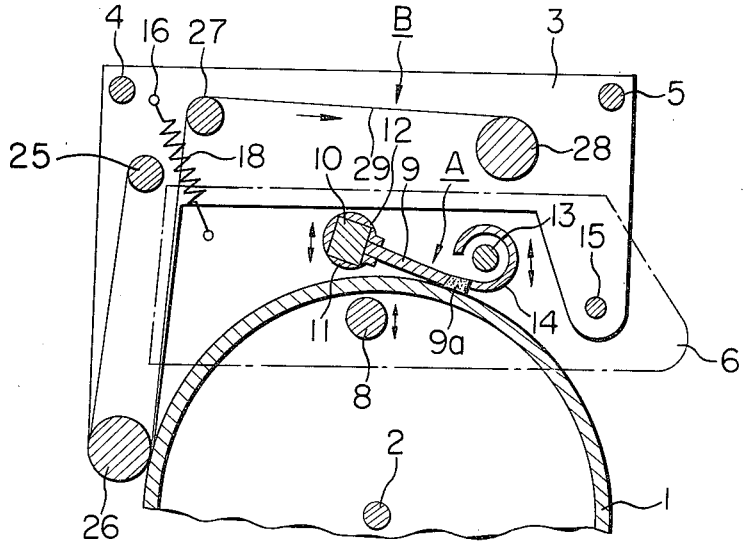
FIG. 5 shows, in cross-section, a modification of the embodiment of the invention.

FIG. 5 shows such modification of the above embodiment shown in FIGS. 1 to 4. In FIG. 5, members and parts corresponding to those in the above embodiment are designated by the same reference numerals as used in FIGS. 1–4.

The cleaning apparatus shown in FIG. 5 comprises two cleaning units, that is, a first cleaning unit A and a second cleaning unit B.

The first cleaning unit A is of blade type and includes a pair of main side plates 3, 3' and a pair of subside plates 6, 6', and an elastic cleaning blade 9 held therebetween. The structure of the first unit is the same as that of the cleaning apparatus in the above embodiment.

The second cleaning unit B is provided between the main side plates 3 and 3'. The cleaning unit B is formed as a web type of cleaning apparatus and comprises a web supplying shaft 25, a web feed shaft 26, a guide tube 27 and a web taking-up shaft 28. A cleaning web 29 extending from the web supplying shaft 25 to taking-up shaft 28 passing through the members 26 and 27 is moved in the direction of arrow by a driving means not shown and at the position of the web feed shaft 26, the web is pressed against the surface of the drum 1 to effect cleaning.

When the cleaning apparatus is mounted on the image forming apparatus, the stay 10 and the guide shaft 15 are fixed to the body of the apparatus in predetermined positions in the manner previously described. Therefore, the sub-side plates 6, 6' engaged with both of the stays 10 and the guide shaft 15 become fixed at the time of mounting. Also, the cleaning unit A becomes fixed at its blade supporting position. However, since the main side plates 3, 3' on which the second cleaning unit B is provided is supported only by the fixed guide shaft 15, the main side plates are held pivotally movable about the guide shaft 15 after the mounting of the cleaning apparatus. Between a pin 16 on the main side plate 3 and a pin 17 on the sub-side plate 6 there extends a tension spring 18. Also, there is provided a tension spring 18' between a pin 16' on the main plate 3' and a pin 17' on the sub-side plate 6'. The main side plates 3, 3' carrying thereon the second cleaning unit are, therefore, subjected to a counterclockwise rotational moment around the guide shaft 15 by their own weight and the tension force of the springs 18, 18'. This moment of counterclockwise rotation acts on the web feed shaft 26 of the second cleaning unit B as a pressure which tends to press the web 29 against the drum surface. This pressure assures a good cleaning effect of the web. The amount of pressure applied to the web in this case can be adjusted as desired by suitably selecting the diameter of the tension spring 18(18') and the positions of pins 16(16'), 17(17').

The driving force necessary for feeding the web 29 and also the driving force required for driving the residual developer conveying screw 13 may be obtained from the driving force used for rotating the drum 1. For example, the necessary driving forces may be obtained from the gear *2a* shown in FIG. 2.

The cleaning apparatus of the modification shown in FIG. 5 can be removed together with the drum from the image forming apparatus in the same manner as previously described in connection with the embodiment shown in FIGS. 1 to 4, which is as follows:

At the beginning of the removal of the cleaning apparatus and the drum together from the image forming apparatus, both ends of each stay 10 and the guide shaft 15 are disengaged from the slots **19*a* formed on the side supporting walls of the body of the apparatus. Thereby, the stay and the guide shaft are allowed to freely move. At the same time, under the action of the tension springs 18 and 18', the rollers 8(8') on the sub-side plates are urged against the inner side surface of the drum 1 at both side ends thereof. After the sub-side plates come into contact with the backside surface of the drum and the movement of the sub-side plates is stopped by it, the force of springs 18(18') exerts on the main side plates 3(3') with a moment intending to rotate the main side plates about the web feed shaft 26. As a result, the web feed shaft 26 and the sleeve 14 are pressed against the outer surface of the drum 1 under the tension force of the springs 18(18'). In this manner, the drum is pressed from its outer side by the web feed shaft 26 through the web 29 and the sleeve 14 through the sheet member 24 on the one hand and also from the inner side by the rollers 8(8') on the sub-side plates on the other hand. Namely, the web guide shaft and the sleeve, and the rollers grasp the drum therebetween. The cleaning apparatus and the drum 1** united together in this manner can be mounted on and removed from the image forming apparatus as a single unit.

As will be understood, the web feed shaft 26 in this modification performs the same function as that of the rollers 7(7') on the main side plates in the embodiment previously shown in FIGS. 1 to 4. Like the case of the first embodiment, the drum is held grasped at three points, namely, two points on the outer surface and one point on the backside surface. Of course, the number of these grasping points may be increased or decreased as desired. Further, any suitable member other than the above described rollers and sleeve may be used to grasp the drum with pressure.

Figure 6:
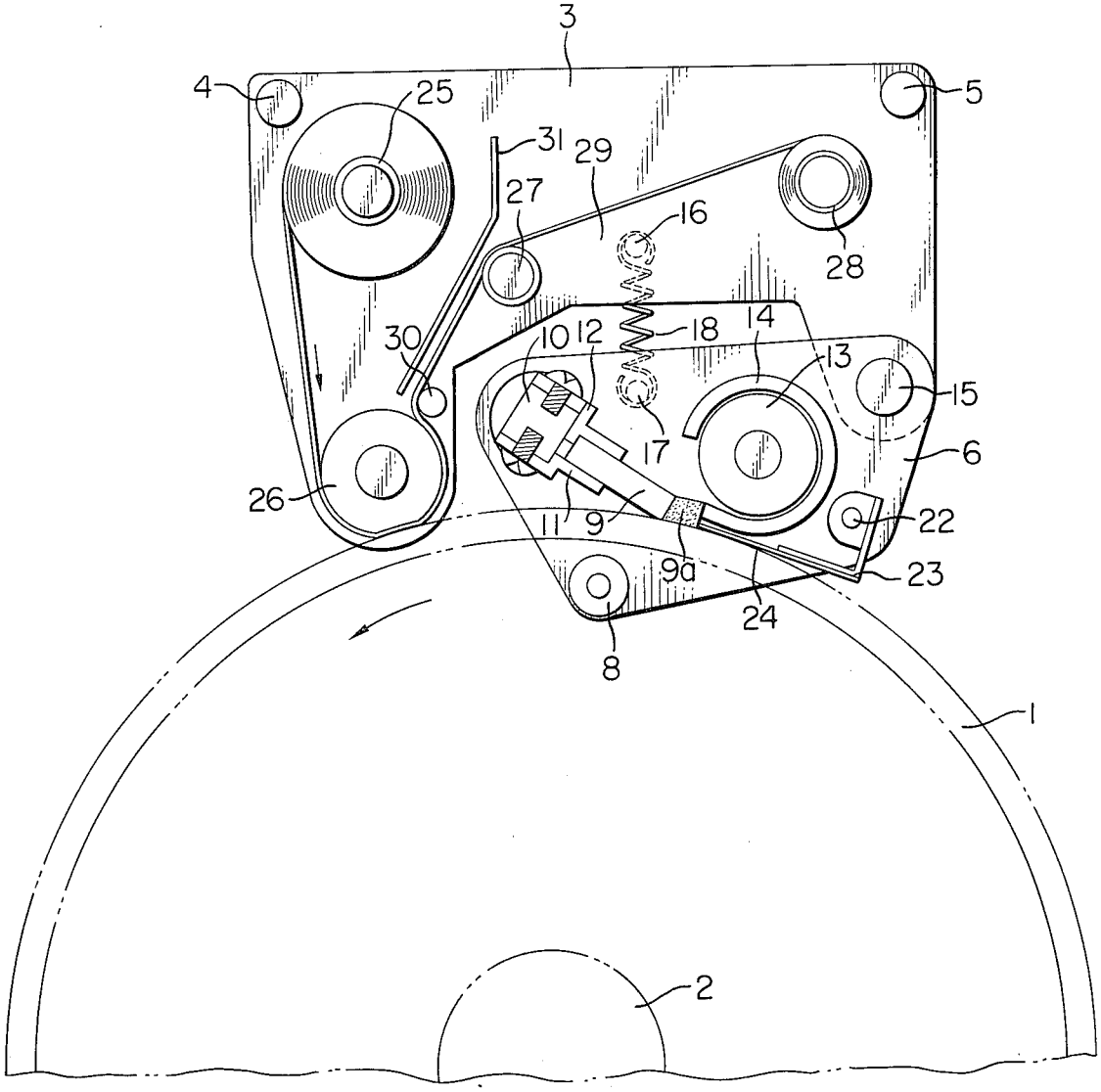
FIG. 6 shows another modification.

FIG. 6 shows a further modification of the embodiment of the invention. According to the modification shown in FIG. 6, the feeding of a web in the apparatus shown in FIG. 5 is improved with respect to the reliability of the feeding. Again, the same reference numerals designate the same members and parts.

The modification shown in FIG. 6 is featured by the provision of a pressing roller 30 for the web feed shaft 26 and a sheet member 31. The function of the pressing roller 30 is to give the web 29 a larger and tight wrapping about the web feed shaft 26 so as to transmit a sufficient amount of feeding force from the shaft 26 to the web 29. The sheet member 31 is disposed to limit the wrapping of the web round the web feed shaft 26. One end of the sheet member 31 is positioned close to the surface of the web feed shaft 26 but at a position somewhat downstream from the contact position of the pressing roller 30 with the drum as viewed in the direction of the rotation of the web feed shaft. This arrangement prevents the web from wrapping the web feed shaft too much beyond the position of the pressing roller 30.

As will be understood from the foregoing, the present invention eliminates the troubles of falling and scattering of residual developing powder which hitherto occurred at the time of the photosensitive drum being removed and remounted. According to the invention, at the time of mounting and removing, the cleaning apparatus and the drum are engaged wth each other to unit them into one single unit. Therefore, it is possible to mount and remove the cleaning apparatus and the drum together. It is no longer necessary to adjust the relative position between the drum and the cleaning apparatus after mounting. Furthermore, it becomes unnecessary to worry about the position at which the cleaning apparatus should be mounted on an image forming apparatus because there is no problem of falling and scattering of developer. The cleaning apparatus is allowed to be mounted at its optimum position.

While the invention has been particularly shown and described with reference to preferred embodiments thereof, it will be understood by those skilled in the art that the foregoing and other changes in form and details can be made therein without departing from the spirit and scope of the invention.

What we claim is:

1. A cleaning apparatus for use in an image forming apparatus of the type in which a developed image is formed on an image carrier and after the formed image has been used, said image carrier is cleaned up for repetitive use, said cleaning apparatus comprising:

a cleaning member;

means for supporting said cleaning member so that said cleaning member contacts said image carrier; and means engageable with said image carrier for grasping said image carrier, said grasping means comprising an outer surface pressing member disposed to apply a holding pressure on the outer surface of said image carrier and an inner surface pressing member disposed to apply a holding pressure on the inner surface of said image carrier.

2. A cleaning apparatus as claimed in claim 1, wherein said image carrier grasping means further comprises a main supporting member for movably supporting said outer surface pressing member and a subsidiary supporting member for movably supporting said inner surface pressing member.

3. A cleaning apparatus as claimed in claim 1, wherein said image carrier grasping means further comprises an elastic force applying member for elastically grasping said image carrier.

4. A cleaning apparatus as claimed in claim 3, wherein said cleaning member is an elastic cleaning blade.

5. A cleaning apparatus as claimed in claim 1, wherein said image carrier grasping means includes means for disabling its grasping action by separating said pressing members, said disabling means being engageable with a member mounted on the image forming apparatus when said cleaning apparatus is mounted in place.

6. A cleaning apparatus for use in an image forming apparatus of the type in which a developed image is formed on an image carrier and after the formed image has been used, said image carrier is cleaned up for repetitive use, said cleaning apparatus comprising:

a plurality of cleaning members;

means for supporting said cleaning members so that each individual cleaning member contacts said image carrier; and means engageable with said image carrier for grasping said image carrier, said grasping means comprising an outer surface pressing member disposed to apply a holding pressure on the outer surface of said image carrier and an inner surface pressing member disposed to apply a holding pressure on the inner surface of said image carrier.

7. A cleaning apparatus as claimed in claim 6, wherein one of said cleaning members is a cleaning web.

8. A cleaning apparatus as claimed in claim 7, wherein said cleaning member supporting means for said cleaning web serves also as the outer surface pressing member of said image carrier grasping means.

9. A cleaning apparatus as claimed in claim 6, wherein said image carrier grasping means further comprises a main supporting member for movably supporting said outer surface pressing member and a subsidiary supporting member for movably supporting said inner surface pressing member.

10. A cleaning apparatus as claimed in claim 6, wherein said image carrier grasping means includes an elastic force applying member for elastically grasping said image carrier.

11. A cleaning apparatus for use in an image forming apparatus of the type in which a developed image is formed on an endlessly movable image carrier and after the formed image has been used, said image carrier is cleaned up for repetitive use, said cleaning apparatus comprising:

a cleaning device;

side plates provided adjacent both lateral ends of said image carrier; and supporting members, provided on said side plates, for engaging said image carrier from opposed sides thereof to allow the cleaning apparatus to be placed into or removed from the image forming apparatus while engaged with the image carrier.

12. An apparatus according to claim 11, wherein said cleaning apparatus is engageable with a drum shaped image carrier which is removable from a shaft about which such image carrier is rotatable.

* * * * *